US005088159A

United States Patent [19]

Lafleur

[11] Patent Number: 5,088,159

[45] Date of Patent: Feb. 18, 1992

[54] SECURITY SEAL BRACELET

[76] Inventor: Serge Lafleur, 1900 Ivry, Duvernay, Quebec, Canada, H7G 1S8

[21] Appl. No.: 616,911

[22] Filed: Nov. 21, 1990

[51] Int. Cl.[5] ..... B65D 63/00

[52] U.S. Cl. ..... 24/16 PB; 24/17 A; 24/17 AP

[58] Field of Search ..... 24/16 PB, 17 AP, 16 R, 24/17 A; 292/318; 248/74.3

[56] References Cited

U.S. PATENT DOCUMENTS

| | | | |
|---|---|---|---|
| 2,653,400 | 9/1953 | Sutherland . | |
| 2,893,143 | 7/1959 | Mosher, Jr. et al. . | |
| 3,766,608 | 10/1973 | Fay . | |
| 3,875,618 | 4/1975 | Schuplin . | |
| 3,983,603 | 10/1976 | Joyce . | |
| 4,001,898 | 1/1977 | Caveney | 24/16 PB |
| 4,136,148 | 7/1979 | Joyce . | |
| 4,272,900 | 6/1981 | MacLarty . | |
| 4,506,415 | 3/1985 | Swift . | |
| 4,537,432 | 8/1985 | Meeks | 24/16 PB X |
| 4,788,752 | 12/1988 | Kraus et al. | 24/16 PB |

FOREIGN PATENT DOCUMENTS

| | | |
|---|---|---|
| 2361563 | 10/1978 | France . |
| 1529401 | 10/1978 | United Kingdom . |
| 2058194 | 4/1981 | United Kingdom . |

*Primary Examiner*—Laurie K. Cranmer

[57] ABSTRACT

A tamper-proof bracelet is disclosed, which comprises an elongated band having at least one opening at one end, and a fastener at the other end. This fastener is in the shape of a housing having circumscribing walls, two of which are transverse to the band, a top wall and a bottom wall. At least one of the transverse walls is formed, close to the bottom wall, with a through aperture size to allow snug insertion of the one end of the band into the housing. Above the aperture and solid with the transverse wall is a locking tongue extending lengthwisely in the housing and gradualy tapering down into a thin edge, the tongue being resilient at least in the area of the thin edge and having a length sufficient to engage the opening in the one end of the band when the same is pushed into the housing through the aperture. A ramp projects up from the housing bottom wall to force upwardly the one end of the band when the same is inserted in the housing and to keep this band in fully engaged position after insertion, whereby any attempt at pulling the one end of the band out of the housing while lifting the tongue with the blade inserted into the aperture in order to tamper the bracelet, is rendered much more difficult.

7 Claims, 3 Drawing Sheets

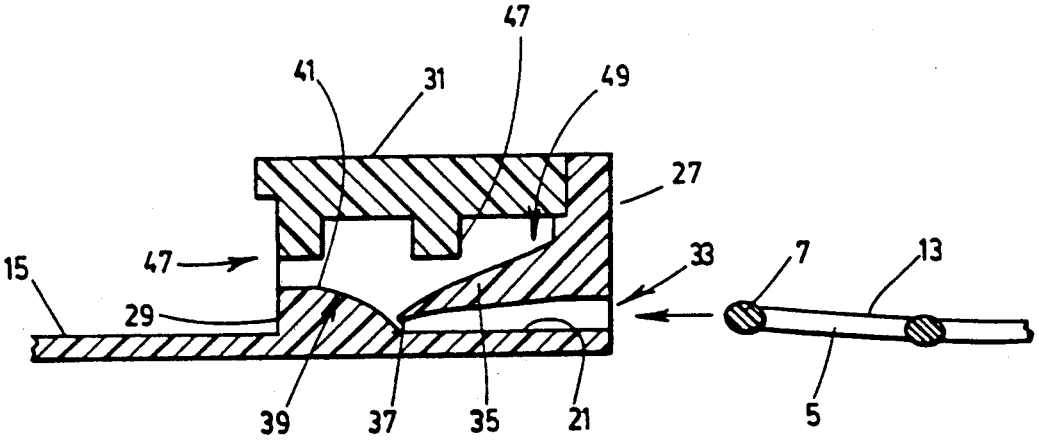
FIG. 3
FIG. 4
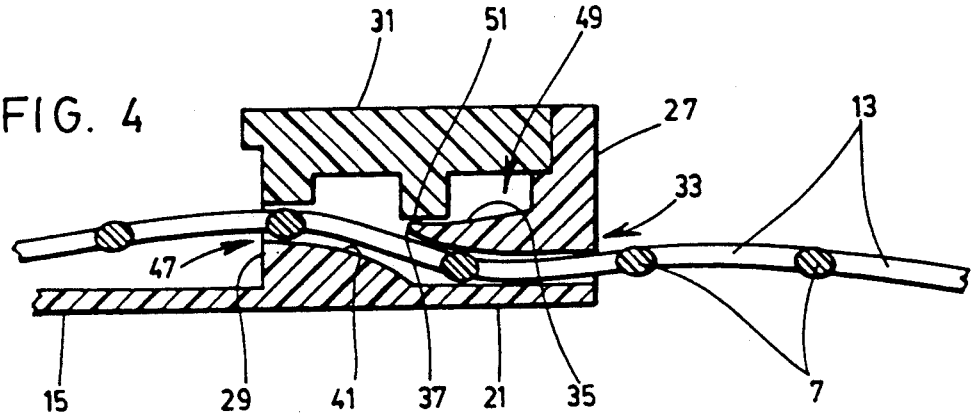
FIG. 5
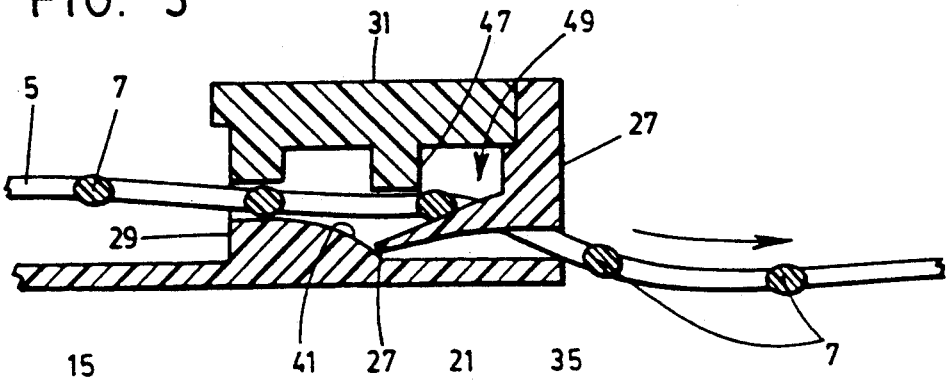

SECURITY SEAL BRACELET

BACKGROUND OF THE INVENTION

1. Field of the Invention

The present invention relates to a tamper-proof bracelet for use as an identification wrist article, particularly in hospitals, for patients. Such bracelets are also used as security tie where they serve to seal a container such as a bag containing valuable articles. The bracelets are then security seals.

2. Description of the Prior Art

As mentioned above, identification wrist bracelets are widely used in hospitals and other like institutions and serve of course to establish the identity of the holder at all times, and sometimes also provide useful information that may be necessary in cases of emergency. Generally, one end of the bracelet is provided with a fastener device through which the other end of the bracelet extends and into which it is safely locked. The bracelet is so constructed that under most circumstances, it will not unlock nor will the lock break unless it is tampered with. However, tampering with the bracelet often happens, using simple tools such as thin blade knives to free the bracelet from the wrist. Indeed, present day bracelets of this type are not truly designed to prevent such pilfering.

The same may be said about security ties used in closing up bags or the like containing valuable materials. They can be safely locked for use under normal conditions but may more or less easily be opened with simple tools and locked up again so that pilfering cannot readily be detected.

SUMMARY OF THE INVENTION

The object of the invention is mainly to provide a tamper-proof bracelet that can be locked safely while being almost impossible to unlock by adequate tools such as a small blade, and eventually relock.

The tamper-proof bracelet according to the invention is of the type comprising a thin band of plastic material, provided with at least one opening at one end, and a fastener at the other end to receive and keep locked the one end of the band, which is preferably in the form of a ladder comprising a pair of side members joined by transverse rungs. The fastener at the other end of the band has circumscribing walls, two of which are transverse to the band, a top wall and a bottom wall. At least one of these transverse walls has a through aperture sized to allow snug insertion of the one end of the band into the housing. A resilient locking tongue is provided in the housing. This locking tongue extends lengthwisely in the housing from the transverse wall in which the through aperture is made, so as to slope down toward the bottom of the housing. Close to the end of the tongue is a ramp projecting from the bottom wall and having a top ramp surface slopping upwardly away from the insertion aperture.

When the band is inserted in the housing, each rung entering the housing is applied beneath the resilient tongue and lifts it up, as the one end of the band rides on the upwardly slopping ramp surface. When every rung has passed beyong the tongue, the tip of this tongue falls down into the fastening opening located behind the rung and thus returns to the bottom of the housing, thereby preventing withdrawal of the band from the housing by rearwardly pulling thereon.

The main advantage of this particular structure is that the ramp renders very difficult not to say impossible any attempt at tampering the bracelet by pulling the front end of the band rearwardly out of the housing while simultaneously lifting the tongue with a small blade inserted into the aperture. Indeed, because of the ramp, the blade cannot lift the tongue without simultaneously engaging the opening in which the tongue is engaged. As a result, the end of the band provided with the opening(s) remains always locked by either the tongue or the blade used to tamper the bracelet.

In accordance with a preferred embodiment of the invention, the top wall of the housing is provided with the block projecting downwardly therefrom at a given distance from the transverse wall where the opening is located, to define therewith a rung locking chamber. This block has a lower surface terminating short of a locking tongue, to prevent the same from being lifted up too much.

This embodiment is interesting inasmuch as any attempt at dislodging a rung and pulling on the band to free the rung and band from the housing causes the rung to be forced up into the rung locking chamber and be locked therein.

In accordance with another preferred embodiment of the invention, the other transverse wall toward which the ramp slopes down also has a through aperture located just above the top ramp surface to serve as an outlet to the band. This particular embodiment allows a bracelet whose insertable end is of a ladder-like construction to be inserted and adjusted at will through the fastener housing prior to being permanent locked therein by merely pulling back onto the band to cause any rung inside the housing to move up into the rung locking chamber and remain locked therein.

Applicant is aware of prior patents addressing similar problems as those mentioned above, said patents being:

U.S. Patents

U.S. Pat. No. 2,653,400 - Sept. 29, 1953
U.S. Pat. No. 2,893,143 - July 7, 1959
U.S. Pat. No. 3,766,608 - Oct. 23, 1973
U.S. Pat. No. 3,875,618 - Apr. 8, 1975
U.S. Pat. No. 3,983,603 - Oct. 5, 1976
U.S. Pat. No. 4,136,148 - Jan. 23, 1979
U.S. Pat. No. 4,272,900 - June 16, 1981
U.S. Pat. No. 4,506,415 - Mar. 26, 1985

French Patent 2,361,563 - Aug. 9, 1976

British Patents 1,529,401 - Oct. 18, 1978
2,058,194 - Apr. 8, 1981

None of these documents, taken alone or in any form of combinations, discloses a bracelet as herein disclosed and claimed, that uses a downwardly inclined resilient locking tongue pointing towards a ramp having an upwardly inclined top ramp surface "facing" the fastener housing aperture to make pilfering very difficult not to say impossible. None of these documents also discloses or suggests a bracelet provided with a rung locking chamber as disclosed and claimed herein.

A better understanding of the invention will be had by the description that follows of two preferred embodiments thereof, made in conjunction with the appended drawing.

BRIEF DESCRIPTION OF THE DRAWING

FIGS. 3, 4 and 5 are longitudinal cross-sectional view of the fastener portion with the other end of the band being slid in, in three successive positions;

DESCRIPTION OF A PREFERRED EMBODIMENT

Figure 1:
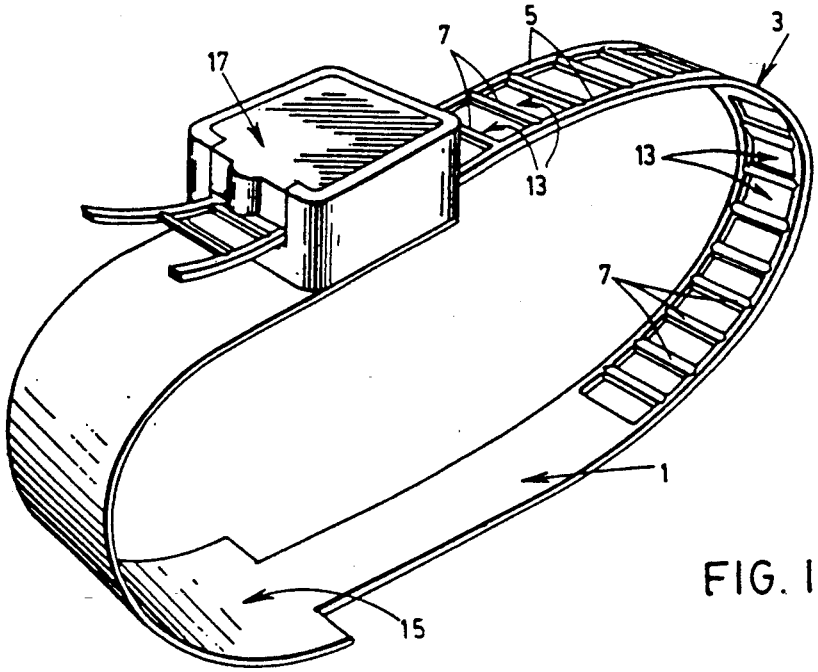
FIG. 1 is a perspective view of a tamper-proof bracelet according to a first embodiment of the invention.
Figure 2:
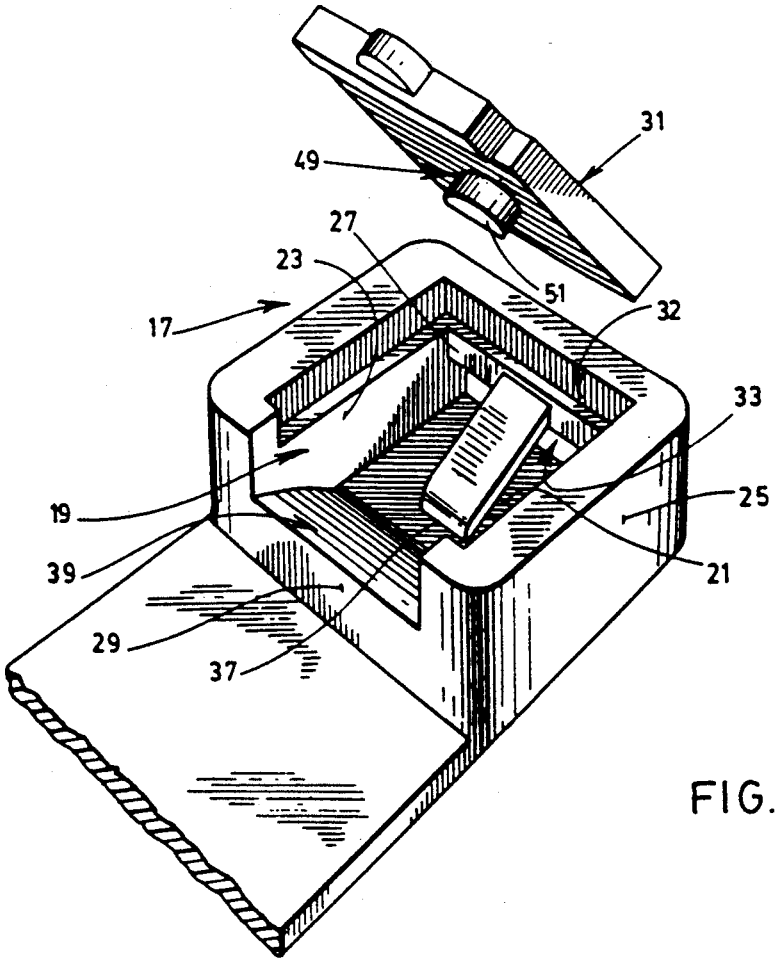
FIG. 2 is a perspective view of the fastener portion of the bracelet shown in FIG. 1, with the top wall removed.

The bracelet according to the invention as shown in the accompanying drawings, is made up of an elongated band 1 having, along an end portion thereof, a ladder-like construction 3 consisting of parallel side members 5 interconnected at intervals by a plurality of transverse rungs 7. The side members 5 and the rungs 7 define a succession of openings 13 for a purpose hereinafter set forth. Preferably, the ladder-like portion of the band is followed by a flat portion 15 that is preferably of greater width and may serve for the application of a tag (not shown).

The other end of the band 1 is provided with a fastener portion 17 forming an integral part with it and having a housing 19 upstanding from one side of the band which acts as the housing bottom wall 21. The housing 19 is also formed by four circumscribing walls of which two are longitudinal walls 23, 25, and the other two, transverse walls 27, 29. The housing further has a top wall 31 which may be glued or ultrasonically welded into a recess 32 provided all along the internal peripheries of the top edges of the walls 23, 25, 27, 29, as shown in FIGS. 3 to 7.

As illustrated, the transverse wall 27 (hereinafter identified as the "front" transverse wall 27) is formed with a through aperture 33 sized for the snug insertion flatwise of the ladder-like end 3 of the band 1. It is located close to the bottom wall 21 of the housing 19, preferably with its lower edge flush with it.

Within the housing 19, there is provided a tapering locking tongue 35 that extends lengthwise into the housing and which has its thicker end made solid with the front transverse wall 27 immediately above the band insertion aperture 33. The tongue 35 gradually tapers down lengthwise towards the housing bottom wall 21, terminating into a thin forward edge 37. With such a construction, and considering that the fastener portion is moulded of plastic material, the tongue 35 is resilient at least in the area of the thin edge 37.

As is clearly illustrated in FIGS. 2 to 7, the resilient tongue 35 points toward the housing bottom wall 21 and is of such a length that its thin forward edge 37 lies close to the housing bottom wall 21 when the tongue is in inoperative position.

In accordance with a very important aspect of the invention, a ramp 39 is provided in the housing 19. This ramp 39 projects up from the housing bottom wall 21 and has a top ramp surface 41 which extends transversally across the housing in front of, and perpendicularly to, the locking tongue 35. The top ramp surface 41 slopes up from the bottom wall 21, substantially from where the thin forward edge 37 of the resilient tongue 35 located, toward the rear transverse wall 29.

The purpose of this ramp 39 is to force upwardly the ladder-like end 3 of the band when the same is inserted into the aperture 33 inside the housing. During this insertion, the central portion of every rung 7 engages the lower surface of the resilient tongue 35 and flex it up as is shown in FIG. 4 while the portion of the ladder-like construction which is forward, rides on the upwardly slopping ramp surface 41. As soon as one rung 7 has passed beyong the resilient tongue 35, the thin edge 37 of this tongue returns into its relaxed position where it engages into the opening 13 which is forwardly edged by the one rung 7. Of course, this engagement is repeated while the ladder-like end 3 of the band is pushed into the housing 17.

In the embodiment shown in FIGS. 1 to 6, it is seen that the rear transverse wall 29 also has a through aperture 47 located just above the top ramp surface 41 to serve as an outlet passage for the band when it is necessary to push it further into the housing 19 to prevent it from being too loose around the wrist.

Figure 6:
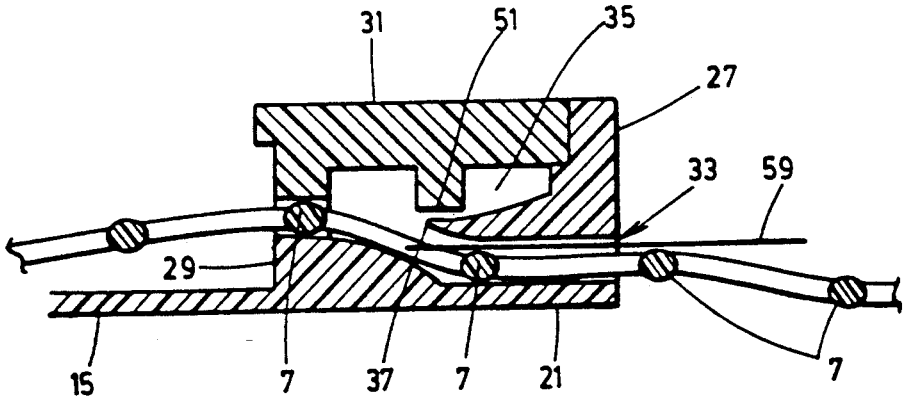
FIG. 6 is a longitudinal cross-sectional view similar to the one of FIG. 4, showing how it may be difficult to tamper the bracelet with a thin blade.

A main advantage of the ramp 39 is that it makes tampering of the bracelet with a small blade 49 (see FIG. 6), very difficult not to say impossible. Indeed, as can be seen in FIG. 6, any attempt at pulling the ladder-like end 3 of the band out of the housing while lifting the tongue 35 with the blade 49 inserted into the aperture 33, will be unsuccessful because, due to the ramp 39 case, every rung 7' extending forward the thin edge 37 of the tongue 39 will always move above the tongue 35 and thus remain locked.

In order to further enhance security, the bracelet may be provided with an integral block 47 depending from the top wall 31 and extending downwardly at the short distance from the front transversal 27 to define with it a rung locking chamber 49. The block 47 has a lower end surface 51 terminating short of the upper surface of the tongue 35, as is best shown in FIGS. 3 to 6.

This block 47 has three basic purposes.

The first purpose of this block 47 is to act as a "stopper" for the tongue 35, if someone tries to flex it up with a curved blade in such a manner as to tentatively allow disengagement of the rung 7. Indeed, the block 47 gives enough room under the tongue 35 to let every rung 7 pass but will cause the ladder-like end of the band to jam because of a lack of free space, if, in addition to the ladder-like end, a blade 59 is also inserted through the opening 33.

The second purpose of the block 47 is to define the rung locking chamber 49. Indeed, any pull made on the band will cause the rung 7' which is just forwards the thin edge 39 of the resilient tongue 35 to move up above the tongue 35 and be forced up into the chamber 49 where it remains locked as is shown in FIG. 5.

The third purpose of the block 47 is to make any attempt at tampering the bracelet with a small blade through the other aperture 47 provided in the rear transverse wall 29 much more difficult. Indeed, any attempt to dislodge a locked rung 7 with a small blade from the aperture 47 will be drastically restricted because of the block 49 which extends in front of the aperture 47 and which, as aforesaid, acts as a "vertical" stopper for the resilient tongue 35.

Figure 7:
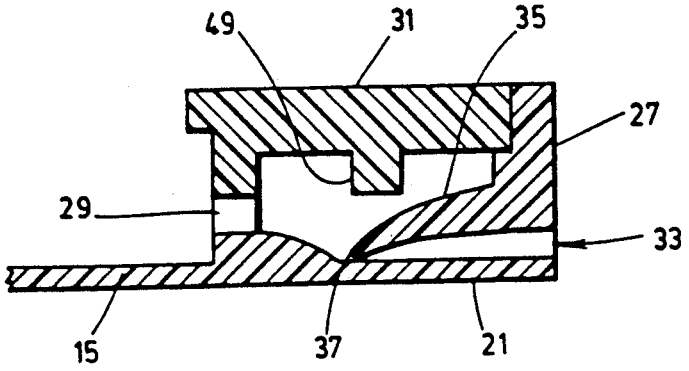
FIG. 7 is a longitudinal cross-sectional view of the fastener portion of another embodiment of the invention.

In another preferred embodiment of the invention shown in FIG. 7, the rear transverse wall 29 of the housing may be plain, i.e. without any aperture 47. In such a case, one may easily understand that the band has to be measured and cut to length prior to insertion into the front aperture 33. This particular embodiment is however very interesting inasmuch as there is no risk for the band to be moved forward inadvertantly and unduly tighten the wrist of the bearer.

Although reference has exclusively been made hereinabove to a band having a ladder-like end 3, it may understand that the invention may work similarly with a band having only one single opening 13 just at the end of the band which is opposite to the fastener portion 17. In such a case, the front edge of the portion of the band where the single opening 13 is located, acts as a single rung that may be locked in the same manner as disclosed hereinabove, in the housing 19.

The embodiments of the invention in which an exclusive property or privilege is claimed are defined as follows:

1. A tamper-proof bracelet comprising:

an elongated band having a front end and a rear end;

at least one tongue-engageable opening in the front end of said band;

a fastener portion including a housing forming an integral part of said band at the rear end thereof, said housing comprising a bottom wall, a set of side walls including two transverse walls transversal to said band, and a top wall, one of said two transverse walls being formed close to said bottom wall, with a through aperture sized to allow snug insertion of the front end of said band into said housing;

a tapering locking tongue having a thick end solid with said one transverse wall above said through aperture and projecting away from said one transverse wall into said housing, said tongue gradually tapering down lengthwisely thereof, pointing toward said housing bottom wall and terminating into a thin forward edge, said tongue being resilient at least in the area of said thin forward edge and having a length sufficient to engage one of said at least one opening when the front end of the band is inserted and pushed into the housing through said through aperture; and a ramp projecting up from said housing bottom wall, said ramp having a top ramp surface extending transversally to said locking tongue and sloping up towards the other one of said two transverse walls of said housing, said ramp forcing upwardly the front end of said band during insertion of said front end in the housing and keeping it up in fully engaged position after insertion, whereby any attempt at pulling the front end of the band out from the housing while lifting the tongue with a blade inserted into the aperture to tamper the bracelet, is rendered much more difficult;

wherein said bracelet also comprises an additional locking means comprising a block projecting donwardly from said top wall of said housing at a distance from said one transverse wall to define therewith a locking chamber, said block having a lower end terminating short of said locking tongue, whereby any pull-back on the band causes part of the front end of the band adjacent said at least one opening engaged by said tongue to be forced up into said locking chamber and be locked therein.

2. A bracelet as claimed in claim 1, wherein said elongated band has, at least along a length thereof starting from its front end, a ladder-like construction consisting of parallel side members interconnected, at regular intervals by a plurality of transverse rungs, every space between two adjacent rungs defining one of said at least one tongue-engageable opening and wherein said part of the front end of the band forced up into said locking chamber is one of said rungs.

3. A bracelet as claimed in claim 2, wherein said other transverse wall towards which the ramp slopes up also has a through aperture located just above said top ramp surface to serve as an outlet for said band.

4. A bracelet as claimed in claim 1, wherein in inoperative position, said thin forward edge of said resilient tongue lies close to said housing bottom wall and ramp.

5. A bracelet as claimed in claim 4, wherein said other transverse wall towards which the ramp slopes up also has a through aperture located just above said top ramp surface to serve as an outlet for said band.

6. A bracelet as claimed in claim 4, wherein said other transverse wall towards which the ramp slopes up has no aperture.

7. A bracelet as claimed in claim 1 wherein said band has a single tongue-engageable opening exclusively and wherein said other transverse wall towards which the ramp slopes up, has no aperture.

* * * * *